US009007357B2

(12) United States Patent
Park et al.

(10) Patent No.: US 9,007,357 B2
(45) Date of Patent: Apr. 14, 2015

(54) METHODS AND APPARATUS FOR PROCESSING SERIALIZED VIDEO DATA FOR DISPLAY

(75) Inventors: Dae-Jin Park, Dong-gu (KR); Jong-Seon Kim, Seongnam-si (KR); Jae-Youl Lee, Yongin-si (KR); Chang-Min Kim, Seo-gu (KR)

(73) Assignee: Samsung Electronics Co., Ltd. (KR)

( * ) Notice: Subject to any disclaimer, the term of this patent is extended or adjusted under 35 U.S.C. 154(b) by 1276 days.

(21) Appl. No.: 11/831,151

(22) Filed: Jul. 31, 2007

(65) Prior Publication Data

US 2008/0158424 A1 Jul. 3, 2008

(30) Foreign Application Priority Data

Jan. 3, 2007 (KR) ..... 10-2007-0000564

(51) Int. Cl.

| | |
|---|---|
| ***G09G 5/00*** | (2006.01) |
| ***G09G 3/38*** | (2006.01) |
| ***G09G 3/36*** | (2006.01) |
| ***G09G 5/18*** | (2006.01) |
| ***G09G 3/20*** | (2006.01) |

(52) U.S. Cl.

CPC .. *G09G 5/18* (2013.01); *G09G 3/20* (2013.01); *G09G 2310/08* (2013.01); *G09G 2330/06* (2013.01)

(58) Field of Classification Search

None

See application file for complete search history.

(56) References Cited

U.S. PATENT DOCUMENTS

| | | | | |
|---|---|---|---|---|
| 5,917,465 | A * | 6/1999 | Mochizuki et al. | 345/94 |
| 5,986,641 | A * | 11/1999 | Shimamoto | 345/593 |
| 6,115,020 | A * | 9/2000 | Taguchi et al. | 345/99 |
| 6,154,468 | A | 11/2000 | Lin et al. | |
| 6,211,849 | B1 * | 4/2001 | Sasaki et al. | 345/55 |
| 7,432,902 | B2 * | 10/2008 | Yun | 345/96 |
| 7,483,005 | B2 * | 1/2009 | Nakamura et al. | 345/87 |
| 2001/0013850 | A1 * | 8/2001 | Sakaguchi et al. | 345/87 |
| 2002/0003507 | A1 * | 1/2002 | Dodge | 345/3.1 |
| 2002/0017939 | A1 * | 2/2002 | Okuda et al. | 327/296 |

(Continued)

FOREIGN PATENT DOCUMENTS

| | | |
|---|---|---|
| JP | 2001-352318 | 12/2001 |
| JP | 2006-119619 | 5/2006 |
| KR | 2001-0064001 A | 7/2001 |

OTHER PUBLICATIONS

"VGA Signal Generation with the XS Board", Publisher: XESS Corporation, Date: Aug. 25, 1998, Version 1.0.*

(Continued)

*Primary Examiner* — Henry Tsai
*Assistant Examiner* — Christopher Bartels
(74) *Attorney, Agent, or Firm* — Myers Bigel Sibley & Sajovec, PA

(57) ABSTRACT

A method of deserializing signals output from a master can include generating an indication signal based on occurrence of a first signal pattern input via a data line during a first period and occurrence of a second signal pattern input via a clock line during the first period and enabling a deserializer in response to the indication signal and deserializing serialized video data input via the data line during a second period following the first period, in response to a clock signal input via the clock line during the second period. Related circuits are also disclosed.

19 Claims, 11 Drawing Sheets

(56) References Cited

U.S. PATENT DOCUMENTS

| | | | | |
|---|---|---|---|---|
| 2002/0038334 | A1* | 3/2002 | Schneider et al. | 709/203 |
| 2002/0047738 | A1* | 4/2002 | Kamihara | 327/237 |
| 2002/0049887 | A1* | 4/2002 | Takahashi | 711/115 |
| 2002/0126083 | A1* | 9/2002 | Cairns et al. | 345/98 |
| 2002/0136241 | A1* | 9/2002 | Pasqualino et al. | 370/493 |
| 2002/0171613 | A1* | 11/2002 | Goto et al. | 345/87 |
| 2003/0001808 | A1* | 1/2003 | Sakuma et al. | 345/87 |
| 2004/0012612 | A1* | 1/2004 | Chan et al. | 345/619 |
| 2004/0135759 | A1* | 7/2004 | Nirasawa et al. | 345/99 |
| 2005/0025260 | A1* | 2/2005 | Hecht et al. | 375/340 |
| 2005/0146493 | A1* | 7/2005 | Kinjo et al. | 345/89 |
| 2005/0156851 | A1* | 7/2005 | Yun | 345/98 |
| 2005/0172037 | A1* | 8/2005 | Downing et al. | 710/1 |
| 2005/0184979 | A1* | 8/2005 | Sakaguchi | 345/204 |
| 2005/0248519 | A1* | 11/2005 | Okita | 345/87 |
| 2006/0012550 | A1* | 1/2006 | Wang et al. | 345/87 |
| 2006/0050837 | A1* | 3/2006 | Jung | 377/67 |
| 2006/0071897 | A1* | 4/2006 | Moon | 345/98 |
| 2006/0104396 | A1 | 5/2006 | Soriano et al. | |
| 2006/0209745 | A1* | 9/2006 | MacMullan et al. | 370/328 |
| 2006/0232579 | A1* | 10/2006 | Chen et al. | 345/211 |
| 2006/0267988 | A1* | 11/2006 | Hussain et al. | 345/502 |
| 2006/0274017 | A1* | 12/2006 | Nakao | 345/98 |
| 2007/0016778 | A1* | 1/2007 | Lyle | 713/169 |
| 2007/0120805 | A1* | 5/2007 | Yi | 345/100 |
| 2007/0195078 | A1* | 8/2007 | Nagatsuka et al. | 345/204 |
| 2007/0242062 | A1* | 10/2007 | Guo et al. | 345/204 |
| 2007/0286600 | A1* | 12/2007 | Guo et al. | 398/43 |
| 2008/0111773 | A1* | 5/2008 | Tsuge | 345/76 |
| 2009/0244052 | A1* | 10/2009 | Takahashi | 345/213 |
| 2009/0252268 | A1* | 10/2009 | Jang | 375/362 |

OTHER PUBLICATIONS

"VGA (VESA DDC) pinout", posted on pinouts.ru, URL: http://pinouts.ru/Video/VGAVesaDdc_pinout.shtml; Date obtained: Sep. 19, 2012.*

* cited by examiner

METHODS AND APPARATUS FOR PROCESSING SERIALIZED VIDEO DATA FOR DISPLAY

CROSS-REFERENCE TO RELATED PATENT APPLICATION

This application claims priority under 35 U.S.C. §119 from Korean Patent Application No. 10-2007-0000564, filed on Jan. 3, 2007, the disclosure of which is hereby incorporated by reference herein as if set forth in its entirety.

FIELD OF THE INVENTION

The present invention relates to the field of electronics in general, and more particularly, to methods and circuits for processing of video data for display.

BACKGROUND

FIG. 1 is a block diagram of a conventional data processing apparatus 10. FIG. 2 illustrates packets transmitted from the data processing apparatus 10 illustrated in FIG. 1. FIG. 3 is a diagram for explaining a skew problem of valid video data generated by the data processing apparatus 10 illustrated in FIG. 1. Referring to FIGS. 1 through 3, the data processing apparatus 10 includes a master 12 (e.g., a timing controller), a plurality of slaves S1 through Sn (e.g., column drivers), and a display panel 14.

The master 12 receives parallel video data P-Data, serializes the parallel video data P-Data, and outputs serialized video data DATA, a clock signal CLK, and a valid video data indication signal VVDS. The valid video data indication signal VVDS indicates a time (or, time-point) at which valid video data starts in the video data DATA.

The serialized video data DATA is transmitted from the master 12 to the individual slaves S1 through Sn via data lines D-Line. The clock signal CLK is transmitted from the master 12 to the individual slaves S1 through Sn via clock lines C-Line. The valid video data indication signal VVDS is transmitted from the master 12 to the individual slaves S1 through Sn via start signal lines S-Line.

Each of the slaves S1 through Sn is enabled by the valid video data indication signal VVDS, deserializes the vide data DATA in response to the clock signal CLK, and detects and outputs valid video data. The display panel 14 displays an image based on the detected valid video data.

However, since the master 12 transmits the valid video data indication signal VVDS to the slaves S1 through Sn via the independent start signal lines S-Line, the start signal lines S-Line may be as many as the number of the slaves S1 through Sn. In addition, since the valid video data indication signal VVDS is transmitted at a complementary metal oxide semiconductor (CMOS) level, it may be distorted due to electromagnetic interference (EMI) during high-speed data transmission between the master 12 and the slaves S1 through Sn. As a result, it may be difficult to detect the valid video data in the slaves S1 through Sn.

Referring to FIG. 2, which illustrates packets transmitted from the master 12 to the individual slaves S1 through Sn, the packet including the valid video data does not include information on where the valid video data starts, and therefore, timepoints at which the valid video data reaches the respective slaves S1 through Sn may be different. Accordingly, the valid video data can be accurately detected when skews between start timing of the valid video data indication signal VVDS and arrival timing when the valid video data reaches the respective slaves S1 through Sn match with one another.

However, as illustrated in FIG. 3, when the valid video data indication signal VVDS is distorted, the valid data may not be detected after a period L2 but may be detected after a period L1. At this time, the valid video data may not be accurately detected. In other words, the valid video data indication signal VVDS may be distorted and thus a skew corresponding to a difference between the period L1 and the period L2 may occur. Due to the skew, the valid video data may not be accurately detected or invalid data may be received.

SUMMARY

In some embodiments according to the present invention, there is provided a method of deserializing signals output from a master. The method can include generating an indication signal based on occurrence of a first signal pattern input via a data line during a first period and occurrence of a second signal pattern input via a clock line during the first period and enabling a deserializer in response to the indication signal and deserializing serialized video data input via the data line during a second period following the first period, in response to a clock signal input via the clock line during the second period.

In some embodiments according to the invention, a method of serializing parallel video data includes outputting a first signal pattern via a data line during a first period and a second signal pattern via a clock line during the first period and serializing the parallel video data and outputting serialized video data via the data line during a second period following the first period and a clock signal via the clock line during the second period.

In some embodiments according to the invention, a data processing method includes outputting a first signal pattern via a data line and a second signal pattern via a clock line during a first period, and serializing parallel video data and outputting serialized video data via the data line and a clock signal via the clock line during a second period. An indication signal is generated based on the first signal pattern and the second signal pattern during the first period, to enable a deserializer in response to the indication signal and deserializing the serialized video data in response to the clock signal during the second period.

In some embodiments according to the invention, a data processing apparatus includes a master that is configured to output a first signal pattern via a data line and a second signal pattern via a clock line during a first period and to serialize parallel video data and output serialized video data via the data line and a clock signal via the clock line during a second period following the first period. A slave is configured to generate an indication signal based on the first signal pattern and the second signal pattern during the first period and to deserialize the serialized video data in response to the indication signal and the clock signal during the second period.

In some embodiments according to the invention, a data processing apparatus includes an indication signal detector that is configured to detect an indication signal based on occurrence of a first signal pattern input via a data line during a first period and occurrence of a second signal pattern input via a clock line during the first period. A deserializer is coupled to the indication signal detector and is configured to be enabled responsive to the indication signal and to deserialize serialized video data input via the data line, in response to a clock signal input via the clock line during a second period after the first period.

BRIEF DESCRIPTION OF THE DRAWINGS

The above and other features and advantages of the present invention will become more apparent by describing in detail exemplary embodiments thereof with reference to the attached drawings in which.

DESCRIPTION OF EMBODIMENTS ACCORDING TO THE INVENTION

Figure 1:
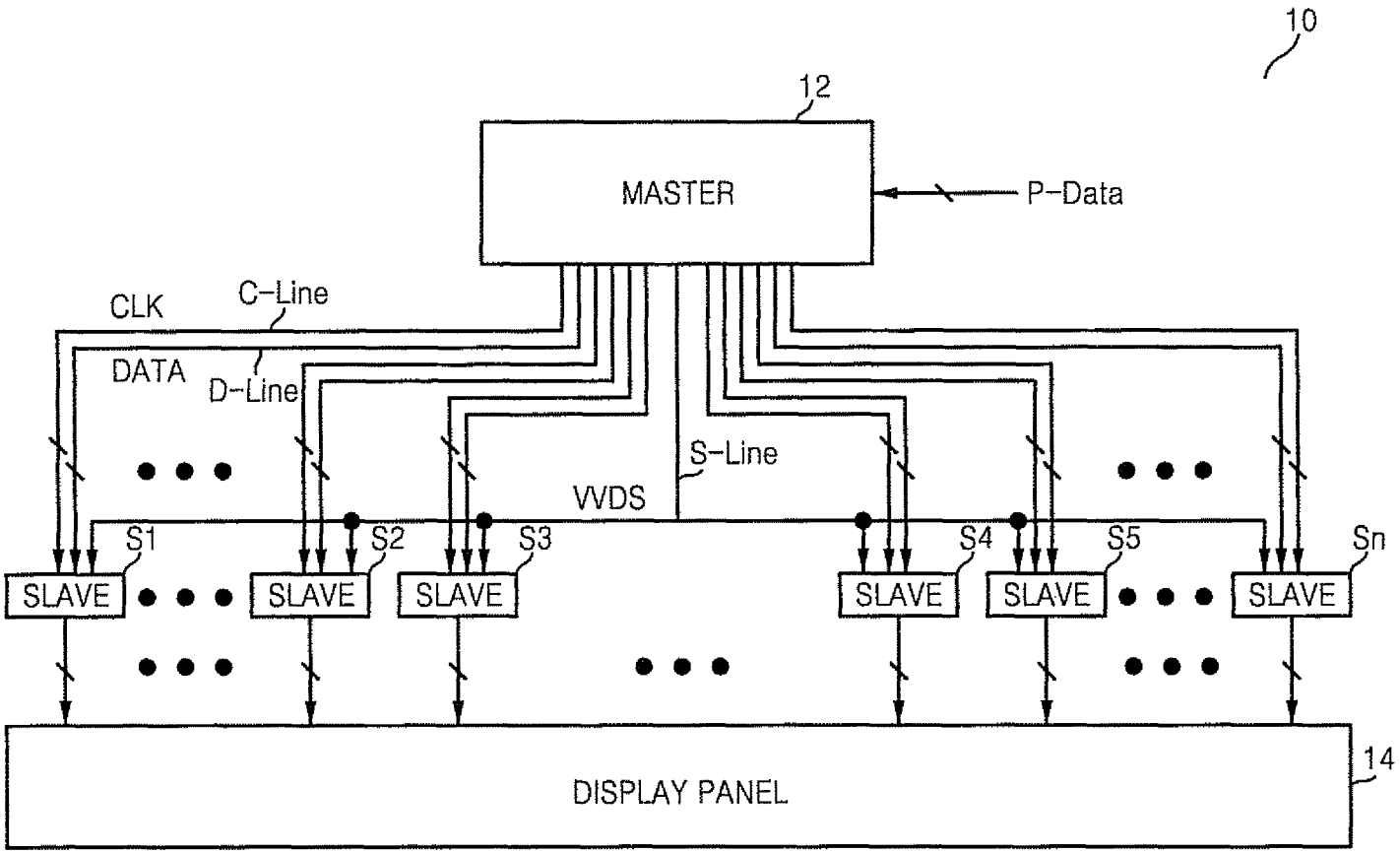
FIG. 1 (CONVENTIONAL ART)
FIG. 1 is a block diagram of a conventional data processing apparatus.
Figure 2:
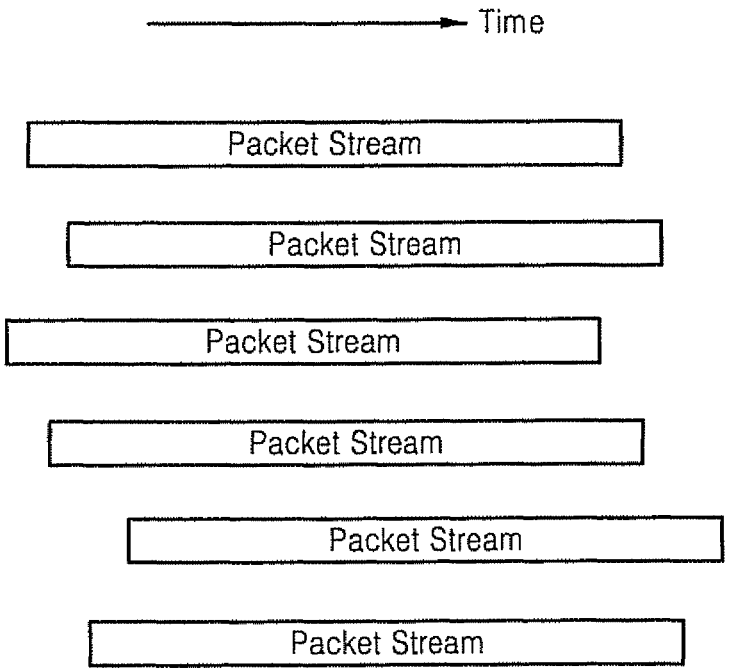
FIG. 2 (CONVENTIONAL ART)
FIG. 2 illustrates packets transmitted from the data processing apparatus illustrated in FIG. 1.
Figure 3:
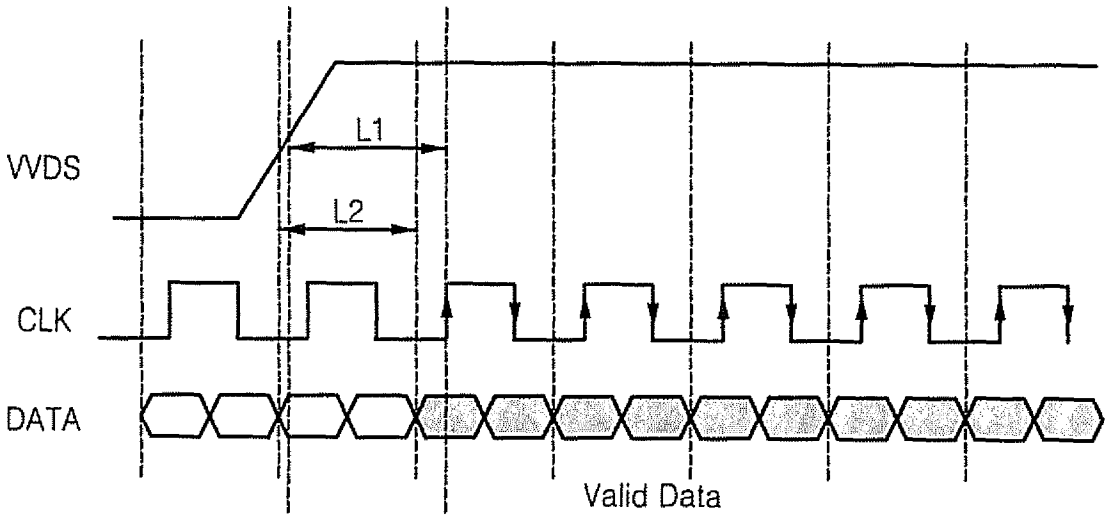
FIG. 3 (CONVENTIONAL ART)
FIG. 3 is a diagram for explaining a skew problem of valid video data generated by the data processing apparatus 10 illustrated in FIG. 1.

The invention now will be described more fully hereinafter with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that some structures having functional names described herein, such as deserializers, serializers, masters, slaves, etc. can be embodied as circuits and/or a combination of software and circuits.

Some embodiments according to the present invention provide methods and apparatus for processing data without an independent signal line for separately transmitting a valid video data indication signal by generating an indication signal indicating a timepoint, at which valid video data of a packet generated from a master starts, based on a first pattern of the packet and a second pattern of a clock signal. Some embodiments according to the present invention provide methods and apparatus for processing data that may be less susceptible to electro-magnetic interference (EMI), which may occur on a transmission line between a master and a slave, by generating a valid video data indication signal based on a first pattern of a packet and a second pattern of a clock signal.

Figure 4:
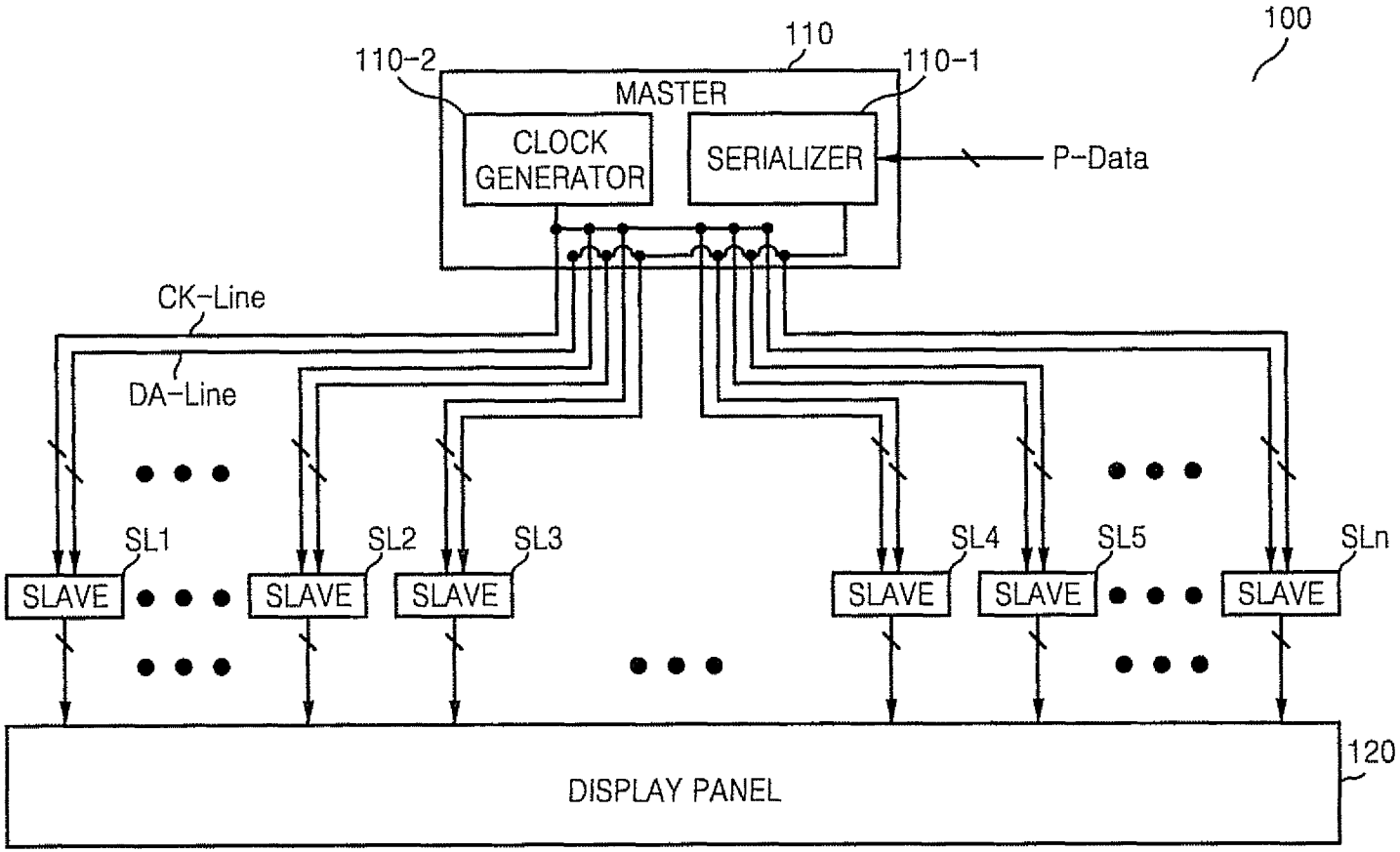
FIG. 4 is a block diagram that illustrates data processing apparatus in some embodiments of the present invention.
Figure 5:
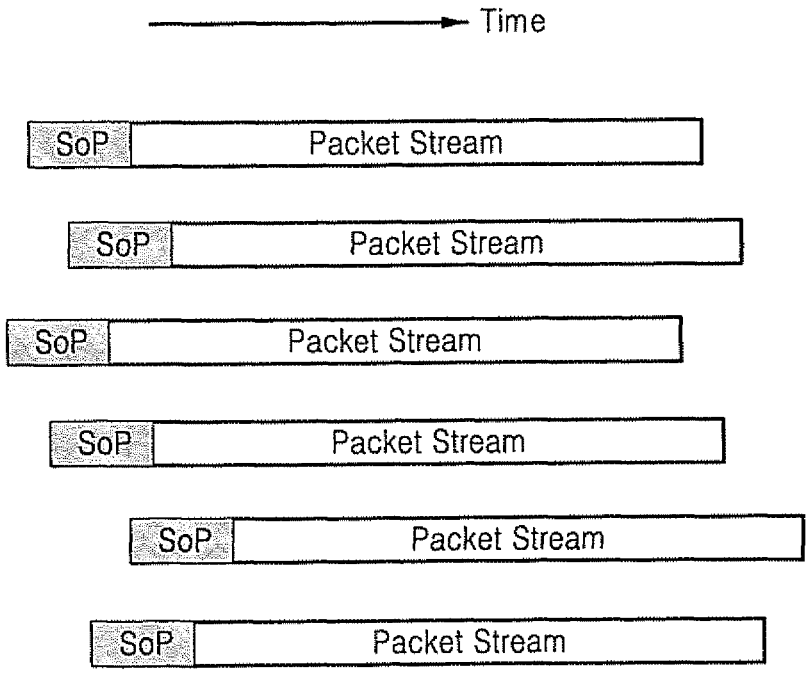
FIG. 5 a schematic representation of packets transmitted from the data processing apparatus illustrated in FIG. 4.
Figure 6:
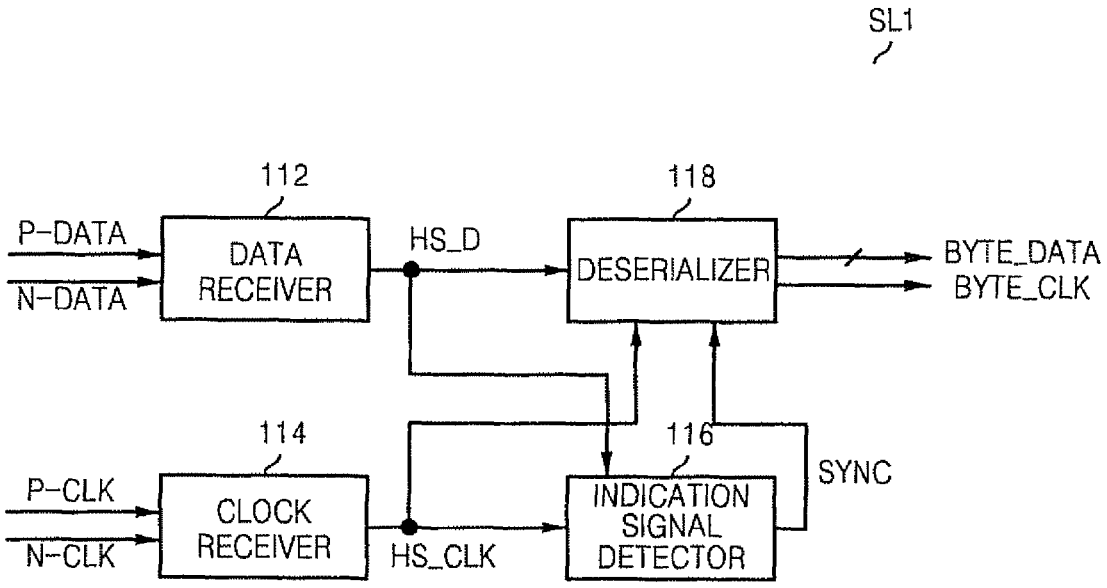
FIG. 6 is a block diagram that illustrates a slave illustrated in FIG. 4.
Figure 7:
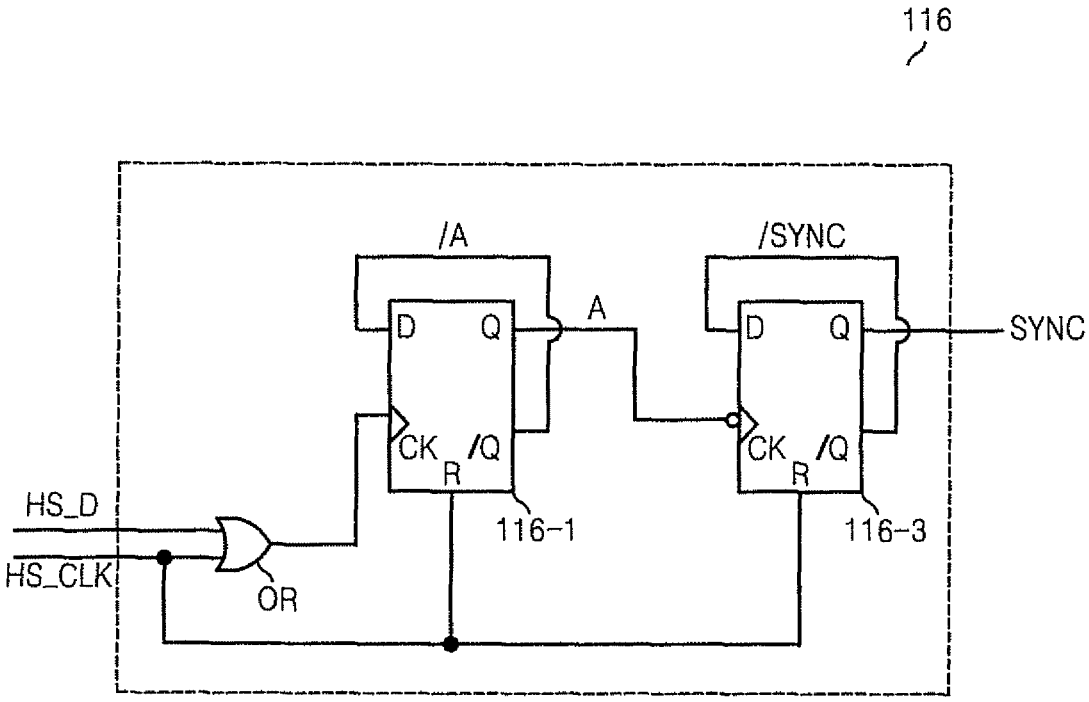
FIG. 7 is a circuit diagram of an indication signal detector illustrated in FIG. 5.
Figure 8:
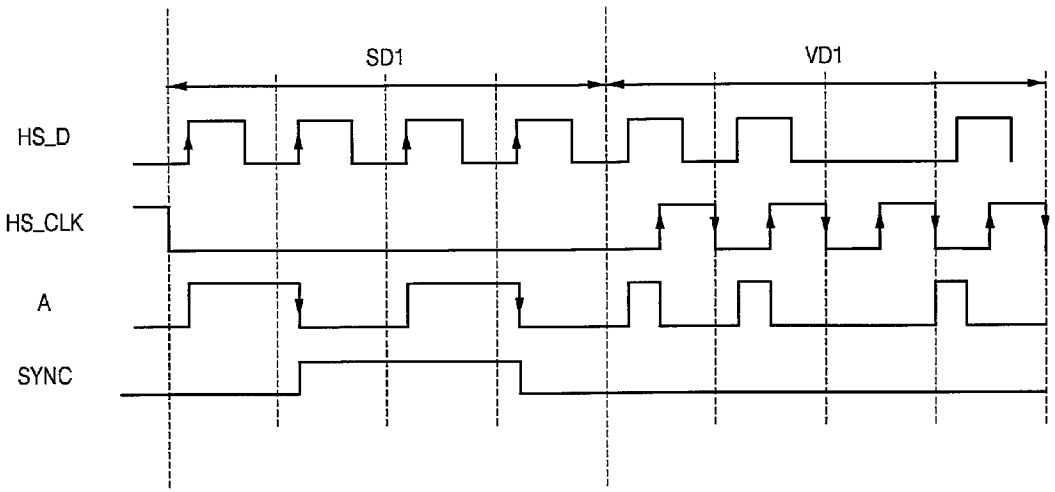
FIG. 8 is an operation timing chart of the indication signal detector illustrated in FIG. 7.

FIG. 4 is a block diagram of a data processing apparatus according to some embodiments of the present invention. FIG. 5 illustrates packets transmitted from the data processing apparatus illustrated in FIG. 4. FIG. 6 is a functional block diagram of a slave illustrated in FIG. 4. FIG. 7 is a circuit diagram of an indication signal detector illustrated in FIG. 5. FIG. 8 is an operation timing chart of the indication signal detector illustrated in FIG. 7.

Referring to FIGS. 4 through 8, a data processing apparatus 100, which may be implemented in a display such as a liquid crystal display (LCD), includes a master (e.g., a timing controller) 110, a plurality of slaves (e.g., column drivers) SL1 through SLn (where, n is a natural number), and a display panel 120. The data processing apparatus 100 may be implemented in portable terminals. When the data processing apparatus 100 is implemented in a folder type portable terminal, the master 110 may be positioned in a lower clamshell of the portable terminal while the plurality of the slaves SL1 through SLn and the display panel 120 are positioned in an upper clamshell of the portable terminal.

The master 110 receives parallel video data P-Data, serializes the parallel video data P-Data, and generates and outputs a clock signal and a packet including serialized video data. The packet may include a first signal pattern SoP and a packet stream of video data, as illustrated in FIG. 5. The first signal pattern SoP includes N oscillations (where N is a natural number) between a first logic state (e.g., a high level of "1" or a low level of "0") and a second logic state (e.g., the low level of "0" or the high level of "1") during a first period SD1 (FIG. 8). The clock signal includes a second signal pattern during the first period SD1. The second signal pattern maintains the first logic state (e.g., the high level of "1" or the low level of "0") during the first period SD1.

For instance, during the first period SD1, the master 110 may output the first signal pattern SoP, e.g., a packet HS_D during the first period SD1 illustrated in FIG. 8, via a data line DA-Line and the second signal pattern, e.g., a clock signal HS_CLK during the first period SD1 illustrated in FIG. 8, via a clock line CK-Line. During a second period VD1 following the first period SD1 in FIG. 8, the master 110 may serialize the parallel video data P-Data and output the serialized video data via the data line DA-Line and the clock signal via the clock line CK-Line. In some embodiments according to the invention, each of the first and second signal patterns can represent a sequence of transitions of a respective signal. For example, in some embodiments according to the invention, the first signal pattern can comprise a series of transitions (or oscillations) of the signal HS_D during the first period SD1. In still other embodiments according to the invention, the information included in the series of transitions that comprise the signal pattern may be absent from a video panel to which the deserialized data is provided. That is, in some embodiments according to the invention, the information used to enable deserialization of the video data is not displayed even though it is transmitted over a data line.

The master 110 may include a serializer 110-1 and a clock generator 110-2. The serializer 110-1 may output the first signal pattern SoP via the data line DA-Line during the first period SD1 and may serialize the parallel video data P-Data and output the serialized video data via the data line DA-Line during the second period VD1. When transmitting the first signal pattern SoP and the serialized video data via the data line DA-Line, the serializer 110-1 may convert them into differential data signals P-DATA and N-DATA The clock generator 110-2 may output the second signal pattern during the first period SD1 and the clock signal HS_CLK during the second period VD1 When transmitting the second signal pattern and the clock signal HS_CLK via the clock line CK-Line, the clock generator 110-2 may convert them into differential clock signals P-CLK and N-CLK.

The slave SL1 generates an indication signal SYNC based on the first signal pattern SoP and the second signal pattern during the first period SD1 and deserializes the serialized video data in response to the indication signal SYNC and the clock signal HS_CLK during the second period VD1. The slave SL1 may include a data receiver 112, a clock receiver 114, an indication signal detector 116, and a deserializer 118.

When the serializer 110-1 outputs the differential data signals P-DATA and N-DATA, the data receiver 112 receives the differential data signals P-DATA and N-DATA and detects the packet HS_D including the first signal pattern SoP and the serialized video data. When the clock generator 110-2 outputs the differential clock signals P-CLK and N-CLK, the clock receiver 114 receives the differential clock signals P-CLK and N-CLK and detects the clock signal HS_CLK including the second signal pattern. The indication signal detector 116 generates the indication signal SYNC based on the first signal pattern SoP and the second signal pattern, which are input via the data line DA-Line and the clock line CK-Line, respectively, during the first period SD1. The indication signal detector 116 includes a logic circuit OR, a first flip-flop 116-1, and a second flip-flop 116-3.

The logic circuit OR receives the packet HS_D input via the data line DA-Line and the clock signal HS_CLK including the second signal pattern input via the clock line CK-Line, performs a logic operation on them, and outputs a signal according to a result of the logic operation. The logic circuit OR may be implemented by an OR circuit or any one among an AND circuit, a NAND circuit, a NOR circuit, an XOR circuit, and an XNOR circuit.

The first flip-flop 116-1 may include an input terminal D for receiving an inverted first output signal /A, a clock terminal CK for receiving an output signal of the logic circuit OR, a first output terminal Q for outputting a first output signal A, a second output terminal /Q for outputting the inverted first output signal /A, and a reset terminal R for receiving the clock signal HS_CLK. The second flip-flop 116-3 latches an inverted indication signal /SYNC based on the inverted first output signal /A and outputs the latched indication signal SYNC. The second flip-flop 116-3 may include an input terminal D for receiving the inverted indication signal /SYNC, a clock terminal CK for receiving the inverted first output signal /A, a first output terminal Q for outputting the indication signal SYNC, a second output terminal /Q for outputting the inverted indication signal /SYNC, and a reset terminal R for receiving the clock signal HS_CLK.

The first flip-flop 116-1 and the second flip-flop 116-3 are reset when the clock signal HS_CLK toggles between the first logic state, e.g., the high level of "1" or the low level of "0", and the second logic state, e.g., the low level of "0" or the high level of "1", N times, that is, when the clock signal HS_CLK is clocking. Accordingly, the indication signal SYNC is disabled during the second period VD1 from the beginning of which the valid video data starts so that the deserializer 118 can deserialize the serialized valid video data in response to a rising edge or a falling edge of the clock signal HS_CLK input after the indication signal SYNC is disabled.

According to some embodiments of the present invention, since the indication signal SYNC indicating a timepoint at which valid video data starts in a packet generated by the master 100 is generated based on a first pattern of the packet and a second pattern of a clock signal without requiring a signal line for transmitting a separate indication signal, an area of the signal line can be reduced and electro-magnetic interference (EMI) occurring in the signal line can be prevented. In addition, when the data processing apparatus 100 is implemented by a folder type mobile phone, the master 110 is positioned in a lower clamshell of the mobile phone and the plurality of the slaves SL1 through SLn and the display panel 120 are positioned in an upper clamshell of the mobile phone, and therefore the number of transmission lines crossing a hinge of the mobile phone is reduced. As a result, manufacturing cost and the failure rate of products can be reduced.

The display panel 120 displays an image based on video data BYTE_DATA and a clock signal BYTE_CLK which are output from each of the slaves SL1 through SLn.

Figure 9:
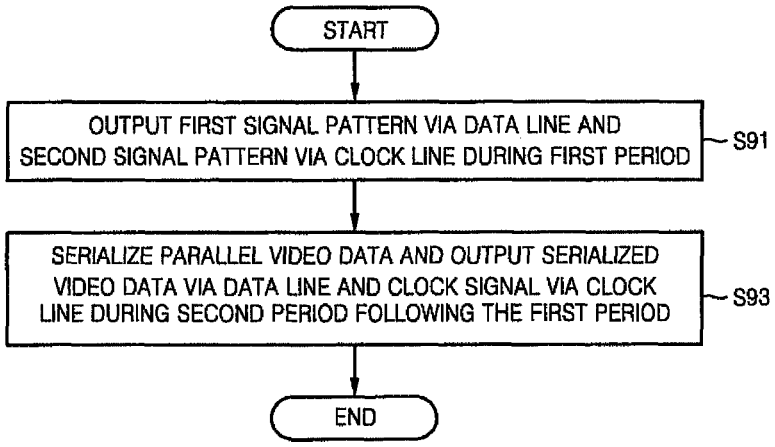
FIG. 9 is a flowchart that illustrates methods of processing video data in some embodiments according to the present invention.

FIG. 9 is a flowchart of a serializing method according to some embodiments of the present invention. Referring to FIGS. 4 through 9, during the first period SD1, the serializer 110-1 outputs the first signal pattern SoP via the data line DA-Line while the clock generator 110-2 outputs the second signal pattern via the clock line CK-Line in operation S91.

During the second period VD1 following the first period SD1, the serializer 110-1 serializes the parallel video data P-Data and outputs the serialized video data via the data line DA-Line while the clock generator 110-2 outputs the clock signal via the clock line CK-Line in operation S93.

Figure 10:
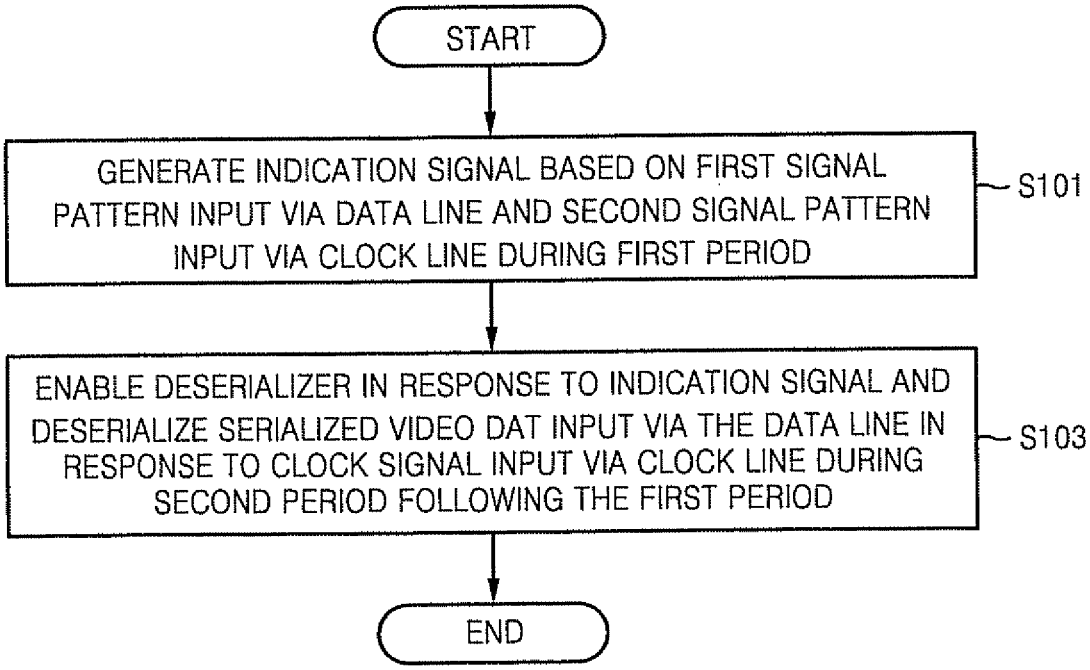
FIG. 10 is a flowchart that illustrates methods of processing video data in some embodiments according to the present invention.

FIG. 10 is a flowchart of a deserializing method according to some embodiments of the present invention. Referring to FIGS. 4 through 8 and FIG. 10, SD1 in operation S101, the indication signal detector 116 generates the indication signal SYNC based on the first signal pattern SoP and the second signal pattern, which are respectively input via the data line DA-Line and the clock line CK-Line, during the first period. In operation S103, the deserializer 118 is enabled in response to the indication signal SYNC and deserializes the serialized video data, which is input via the data line DA-Line, in response to the clock signal input via the clock line CK-Line, during the second period VD1 following the first period SD1.

Figure 11:
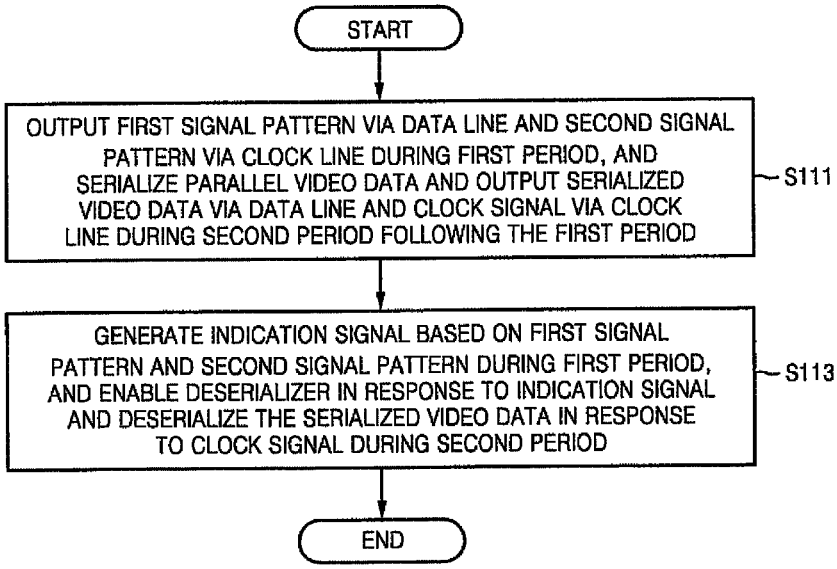
FIG. 11 is a flowchart that illustrates methods of processing video data in some embodiments according to the present invention.

FIG. 11 is a flowchart of a data processing method according to some embodiments of the present invention. Referring to FIGS. 4 through 8 and FIG. 11, in operation S111, the master 110 outputs the first signal pattern SoP via the data line DA-Line and the second signal pattern via the clock line CK-Line during the first period SD1 and the master 110 serializes the parallel vide data P-Data and outputs serialized video data via the data line DA-Line and the clock signal via the clock line CK-Line during the second period VD1 following the first period SD1. In operation S113 the slave SL1 generates the indication signal SYNC based on the first signal pattern SoP and the second signal pattern during the first period SD1 and the slave SL1 is enabled in response to the indication signal SYNC and deserializes the serialized video data in response to the clock signal during the second period VD1.

As described above, according to some embodiments of the present invention, since an indication signal indicating a timepoint, at which valid video data starts in a packet generated by a master, is generated based on a first pattern of the packet and a second pattern of a clock signal without requiring a signal line for transmitting a separate indication signal, an area of the signal line can be reduced and EMI occurring in the signal line can be prevented. In addition, when the present invention is implemented in a folder type mobile phone, the number of transmission lines crossing a hinge of the mobile phone is reduced, and therefore, manufacturing cost and the failure rate of products can be reduced.

While the present invention has been shown and described with reference to exemplary embodiments thereof, it will be understood by those of ordinary skill in the art that various changes in form and detail may be made herein without departing from the spirit and scope of the present invention, as defined by the following claims.

What is claimed:

1. A method of deserializing signals output from a master, the method comprising:

generating an indication signal by a column driver based on occurrence of a first signal pattern input via a data line during a first period and occurrence of a second signal pattern input via a clock line during the first period, wherein the indication signal indicates a time at which valid video data starts in a packet; and enabling a deserializer in response to the indication signal and deserializing serialized video data input via the data line during a second period following the first period, in response to a clock signal input via the clock line during the second period, wherein the serialized video data and the first signal pattern are received via the data line by a slave comprising the column driver and coupled to the master, wherein the indication signal is disabled during the second period, and wherein generating the indication signal comprises generating the indication signal by the column driver before the indication signal is disabled and before deserializing the serialized video data.

2. The method of claim 1, wherein the first signal pattern includes N oscillations between a first logic state and a second logic state during the first period and the second signal pattern maintains the first logic state during the first period where N is a natural number.

3. The method of claim 1, wherein the first signal pattern comprises information used to indicate subsequent timing for subsequent de-serialization of serialized video data during the second period.

4. The method of claim 3, wherein the information included in the first signal pattern is absent from a video panel on which the de-serialized video data is displayed.

5. The method of claim 1, wherein:

the packet includes the first signal pattern and the serialized video data;

the slave receives differential data signals from the master and detects the packet that includes the first signal pattern and the serialized video data in response to receiving the differential data signals;

the clock signal includes the second signal pattern; and the slave receives differential clock signals from the master and detects the clock signal that includes the second signal pattern in response to receiving the differential clock signals.

6. A data processing apparatus comprising:

an indication signal detector configured to detect an indication signal based on occurrence of a first signal pattern input via a data line during a first period and occurrence of a second signal pattern input via a clock line during the first period, wherein the indication signal is generated by a column driver and indicates a time at which valid video data starts in a packet; and a deserializer, coupled to the indication signal detector, configured to be enabled responsive to the indication signal and to deserialize serialized video data input via the data line, in response to a clock signal input via the clock line during a second period after the first period, wherein the serialized video data and the first signal pattern are input via the data line, wherein the indication signal is disabled during the second period, and wherein the indication signal is generated by the column driver before the indication signal is disabled and before the deserializer deserializes the serialized video data.

7. The data processing apparatus of claim 6, wherein the first signal pattern includes N oscillations between a first logic state and a second logic state during the first period and the second signal pattern maintains the first logic state during the first period where N is a natural number.

8. The data processing apparatus of claim 6, wherein the indication signal detector is reset responsive to N oscillations of a second signal, providing the second signal pattern over time, between a first logic state and a second logic state where N is a natural number.

9. The data processing apparatus of claim 6, wherein the indication signal detector comprises:

a logic circuit configured to receive the first signal pattern and the serialized video data via the data line and the second signal pattern and the clock signal via the clock line, to perform a logic operation thereon and to output a signal responsive thereto;

a first flip-flop comprising an input terminal for receiving an inverted first output signal, a clock terminal for receiving the signal output from the logic circuit, an output terminal for outputting a first output signal, and a reset terminal for receiving the clock signal; and a second flip-flop, coupled to the first flip-flop, comprising an input terminal for receiving an inverted indication signal, a clock terminal for receiving the inverted first output signal, an output terminal for outputting the indication signal, and a reset terminal for receiving the clock signal.

10. The data processing apparatus of claim 6, further comprising a display panel configured to display an image based on video data and the clock signal, which are output from the deserializer.

11. A data processing apparatus comprising:

a master configured to output a first signal pattern via a data line and a second signal pattern via a clock line during a first period and to serialize parallel video data and output serialized video data via the data line and a clock signal via the clock line during a second period following the first period; and a slave, coupled to the master, the slave comprising a column driver configured to generate an indication signal based on the first signal pattern and the second signal pattern during the first period and to deserialize the serialized video data in response to the indication signal and the clock signal during the second period, wherein the indication signal indicates a time at which valid video data starts in a packet, wherein the slave is configured to receive the serialized video data and the first signal pattern via the data line, wherein the indication signal is disabled during the second period, wherein the column driver is configured to generate the indication signal before the indication signal is disabled and before deserializing the serialized video data.

12. The data processing apparatus of claim 11, wherein the slave comprises:

an indication signal detector configured to detect the indication signal based on the first signal pattern and the second signal pattern during the first period; and a deserializer configured to be enabled in response to the indication signal and to deserialize the serialized video data in response to the clock signal.

13. The data processing apparatus of claim 12, wherein the first signal pattern includes N oscillations between a first logic state and a second logic state during the first period and the second signal pattern maintains the first logic state during the first period where N is a natural number.

14. The data processing apparatus of claim 12, wherein the indication signal detector is reset when the second signal pattern includes N oscillations between a first logic state and a second logic state where N is a natural number.

15. The data processing apparatus of claim 12, wherein the indication signal detector comprises:

a logic circuit configured to receive the first signal pattern and the serialized video data via the data line and the second signal pattern and the clock signal via the clock line, to perform a logic operation on them, and to output a signal according to a result of the logic operation;

a first flip-flop comprising an input terminal for receiving an inverted first output signal, a clock terminal for receiving the signal output from the logic circuit, an output terminal for outputting a first output signal, and a reset terminal for receiving the clock signal; and a second flip-flop comprising an input terminal for receiving an inverted indication signal, a clock terminal for receiving the inverted first output signal, an output terminal for outputting the indication signal, and a reset terminal for receiving the clock signal.

16. The data processing apparatus of claim 12, further comprising a display panel configured to display an image based on video data and the clock signal, which are output from the deserializer.

17. A data processing method comprising:

outputting a first signal pattern via a data line and a second signal pattern via a clock line during a first period, and serializing parallel video data and outputting serialized video data via the data line and a clock signal via the clock line during a second period; and generating an indication signal by a column driver based on the first signal pattern and the second signal pattern during the first period, and enabling a deserializer in response to the indication signal and deserializing the serialized video data in response to the clock signal during the second period, wherein the indication signal indicates a time at which valid video data starts in a packet, wherein the serialized video data and the first signal pattern are input via the data line, wherein the indication signal is disabled during the second period, and wherein generating the indication signal comprises generating the indication signal by the column driver before the indication signal is disabled and before deserializing the serialized video data.

18. The data processing method of claim 17, wherein the first signal pattern includes N oscillations between a first logic state and a second logic state during the first period and the second signal pattern maintains the first logic state during the first period where N is a natural number.

19. The data processing method of claim 17, wherein the packet includes video data that will be displayed on a video panel.

* * * * *